United States Patent [19]

Tomura et al.

[11] 3,942,070

[45] Mar. 2, 1976

[54] ELECTRIC DISCHARGE LAMP LIGHTING DEVICE

[75] Inventors: Teruichi Tomura, Kunitachi; Mitsuo Akatsuka; Hiroyuki Iyama, both of Tokyo, all of Japan

[73] Assignee: Hitachi, Ltd., Japan

[22] Filed: Sept. 10, 1974

[21] Appl. No.: 504,705

[52] U.S. Cl. ..... 315/101; 315/99; 315/106; 315/DIG. 2

[51] Int. Cl.[2] ..... H05B 41/23

[58] Field of Search 315/98, 99, 101, 103, 105–107, 315/205, 208, 225, DIG. 2, DIG. 5

[56] References Cited

UNITED STATES PATENTS

| | | | |
|---|---|---|---|
| 3,588,592 | 6/1971 | Brandstadter | 315/99 |
| 3,643,127 | 2/1972 | Laupman | 315/101 |
| 3,720,861 | 3/1973 | Kahanic | 315/107 X |

FOREIGN PATENTS OR APPLICATIONS

| | | | |
|---|---|---|---|
| 1,208,489 | 10/1970 | United Kingdom | 315/101 |

*Primary Examiner*—Paul L. Gensler
*Assistant Examiner*—E. R. LaRoche
*Attorney, Agent, or Firm*—Craig & Antonelli

[57] ABSTRACT

An electric discharge lamp lighting circuit in which a discharge lamp is lighted by a circuit comprising a semiconductor switching circuit in which the cathode of a first thyristor is connected to the gate of a second thyristor and the first and second thyristors are commonly connected at the respective anodes, an integration circuit consisting of a capacitor and a resistor and connected between the gate of the first thyristor and the cathode of the second thyristor, a resistor connected between the integration circuit and the anode of the first thyristor, and a resistor connected between the gate and cathode of the second thyristor.

31 Claims, 18 Drawing Figures

ELECTRIC DISCHARGE LAMP LIGHTING DEVICE

FIELD OF THE INVENTION

The present invention relates to an electric discharge lamp lighting device and more particularly a solid state electric discharge lamp lighting device using a semiconductor switching element.

DESCRIPTION OF THE PRIOR ART

Figure 1:
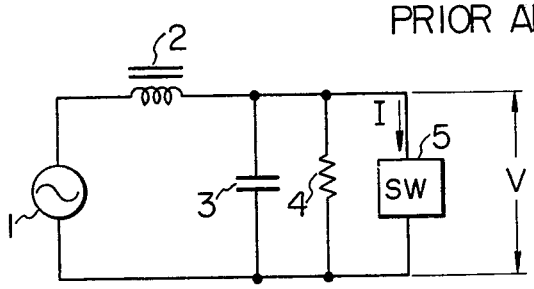
FIG. 1 PRIOR ART
FIG. 1 is a schematic circuit diagram of a conventional pulse voltage generator to illustrate the process of pulse generation.
Figure 2:
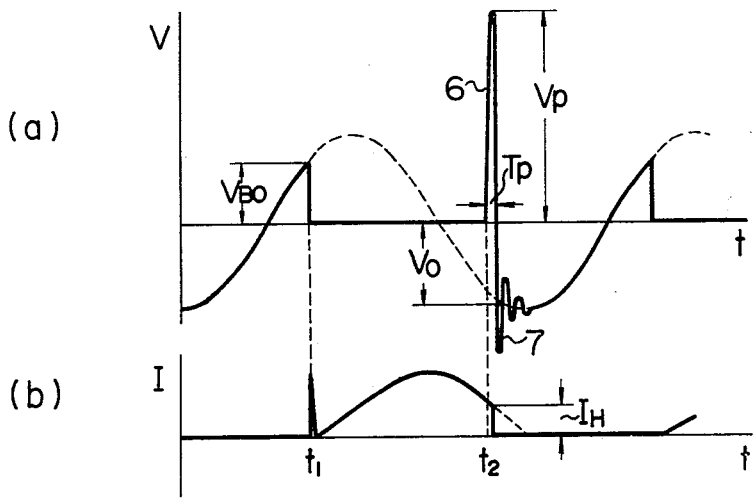
FIG. 2 PRIOR ART
FIG. 2 depicts graphs illustrating current and voltage characteristics for explaining the operation of the pulse voltage generator circuit shown in FIG. 1.

As is well known, pulses are generated by the on-off operation of a switch in the circuit shown in FIG. 1. In the figure, reference numberal 1 designates an a.c. power source, 2 a coil, 3 a capacitor, 5 the switch, and 4 a resistor connected across the switch 5. The capacitor 3 is not essential, but it can be substituted by a stray capacity of the winding of the coil. Energy loss factors such as the resistance of the coil winding, the circuit resistance, etc., are omitted in description, since these may be equivalently included in the resistor 4 to be treated. FIG. 2 illustrates the operation of the circuit in FIG. 1, in which the graph of FIG. 2*a* is depicted with its ordinate representing voltage V and its abscissa representing time *t*, and the graph of FIG. 2*b* with its ordinate current I and its abscissa time *t*. In operation, when the switch 5 is closed at time '$t_1$', the terminal voltage V is reduced to zero, as shown in FIG. 2*a*, while the current I flowing in the switch gradually increases due to the function of the coil 2 after a pulse current flow by the short-circuiting of the capacitor 3. Then, when the switch 5 is opened quickly at time '$t_2$', the current I is abruptly reduced to zero, while at the same time the voltage V oscillates with peaks shown at 6 and 7, as shown in FIG. 2*a*.

The peak 6 is caused by the current flowing in the coil 2 while the peak 7 by an abrupt application of the voltage, and their polarities are opposite to each other, Thus, if the current at the time when the switch 5 is opened is small, the peak 7 plays a major role, while if the current is large, the peak 6 plays a major role. In the mean of the current value, these peaks cancel each other and thus so high peak is not caused.

Assuming that the values of the coil 2, capacitor 3, and resistor 4 are L, C, and R, respectively, each of the above two peak wave forms has a resonant frequency of about $1/(2\pi\sqrt{LC})$, and damps with $\exp(-t/2RC)$. And, their amplitudes are determined by $\sqrt{L/C}\, I_H$ where $I_H$ is the value of the current flowing when the switch is opened, and the source voltage $V_o$ which is applied after the switch is opened, respectively, and the times when the peaks 6 and 7 occur are one-fourth oscillation period and one-half oscillation period after the switch is opened, respectively. Thus with respect to the peak 6, the peak voltage $V_p$ is given by $$V_p \cong \sqrt{\frac{L}{C}}\, I_H e^{-\frac{\pi}{4R}\sqrt{\frac{L}{C}}} - V_o ,$$

and the time duration of the peak occurence is $t_p \cong \pi\sqrt{LC}$. With respect to the peak 7, the peak voltage V is given by $$V \cong \left(1 + e^{-\frac{\pi}{2R}\sqrt{\frac{L}{C}}}\right) V_o .$$

As seen from the equations, the former peak voltage can be made large optionally by selecting the cut-off current $I_H$ large while the latter cannot be made larger than $2V_o$.

Three terminal semiconductor switches such as thristors are known for the switch 5. As is well known, the thyristor is conductive when a trigger current $I_{GT}$ flows into the gate thereof and the flow of current through the anode thereof is permitted. Afterward, when the current decreases to a predetermined value, the thyristor fails to continue its conduction, and returns to the blocking condition. The current at this time is called holding current $I_H$. The holding current $I_H$ is a value proper to a thyristor but it can be made large by connecting a resistor between the gate and the cathode thereof or by applying a reverse bias voltage to the cathode.

Figure 3:
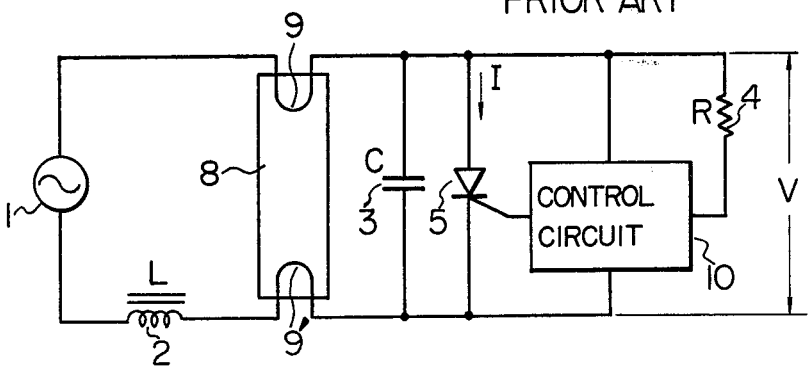
FIG. 3 PRIOR ART
FIG. 3 is a schematic circuit diagram in which the pulse voltage generator circuit shown in FIG. 1 is applied to an electric discharge lamp lighting circuit.

A circuit construction of FIG. 3 shows an example of the electric discharge lamp lighting device to which the pulse generator circuit shown in FIG. 1 using a thyristor as the switch 5 is applied. In FIG. 3, like reference numerals are used to indicate like or equivalent portions in FIG. 1. In the figure, reference numeral 8 designates an electric discharge lamp having filaments 9 and 9'. One terminal of each filament is connected to the power source 1 while the other terminals of the filaments are connected to the anode and the cathode of the thyristor 5, respectively. A control circuit 10 to control the thyristor 5 is connected through the resistor 4 to the power source 1. The control circuit 10 serves to break over the thyristor 7 whose break over voltage is $V_{BO}$ as shown in FIG. 2*a* when the voltage V becomes slightly larger than the steady-state lighting voltage of the discharge lamp 8. On breaking over of the thyristor 7, the thyristor is made conductive and the current I is permitted to flow from the power source 1 to the anode of the thyristor 7. The current I flows through the filaments 9 and 9' thereby heating the filaments. When the current I reaches the holding current $I_H$ of the thyristor 7 due to the change of the voltage of the power source 1, the thyristor 7 becomes in the blocking condition and thus the lamp 8 is lighted by a kick voltage (the pulse voltage 6 shown in FIG. 2*a*, caused due to the inductance of the coil 2.

When the lamp 8 is lighted by the kick voltage, the kick voltage also supplies the trigger current through the control circuit 10 to the gate of the thyristor 5; this makes the thyristor 5 conductive again. It is required thus that the control circuit 10 is provided with a function to prevent this reconduction of the thyristor. More particularly, since the time duration of the kick voltage continued is $\pi \sqrt{LC}$, it is required that the control circuit not operate the thyristor 5 for the period of time corresponding to such time duration.

Figure 4:
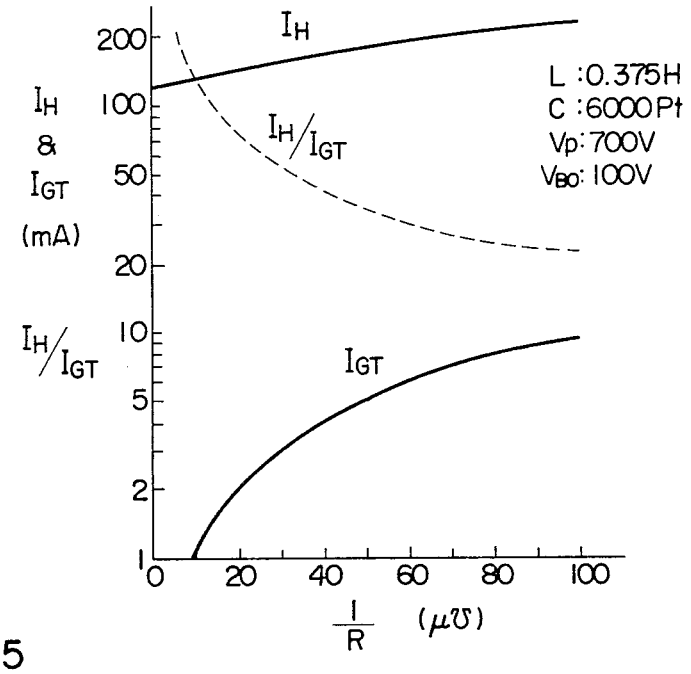
FIG. 4 PRIOR ART
FIG. 4 is a graph showing characteristic curves for explaining the operation of the electric discharge lamp lighting circuit in FIG. 3.

As seen from the equation mentioned previously, in order to light the lamp, it is required to increase the holding current $I_H$, taking absorption of the pulse voltage by the resistor 4 into account. For example, when the inductance of the coil L is 0.375 H, the capacitance of the capacitor C is 6000 pf, and the amplitude of the pulse voltage $V_p$ is 700 V, 100 V of $V_{BO}$ may be attained with the values of $I_H$ and $I_{GT}$ as shown in FIG. 4. In FIG. 4, the reciprocal of the resistance R of the resistor 4 is depicted along the abscissa, and the holding current $I_H$ and the trigger current $I_{GT}$ and the ratio $I_H/I_{GT}$ are depicted logarithmically along the ordinate. In the figure, a solid line *a* indicated $I_H$, a solid line *b* $I_{GT}$ and a dotted line the ratio $I_H/I_{GT}$. When the resistance R is selected 50 to 100 k Ω to restrict heat generated in the resistor 4 during the operation or lighting of the discharge lamp, the ratio $I_H/I_{GT}$ must be within the range of from 50 to 100. Thus, it is required for the control circuit to feed the current $I_H$ and $I_{GT}$ to satisfy such ratio value to the thyristor.

Consequently, if such requirement is not satisfied, the discharge lamp fails to light.

SUMMARY OF THE INVENTION

Accordingly, an object of the present invention is to provide an electric discharge lamp lighting circuit in which the holding current of a three terminal semi-conductor switch is increased while its turn-off time is reduced, and no absorption of the pulse is caused.

Another object of the present invention is to provide an electric discharge lamp lighting circuit capable of reliably lighting the electric discharge lamp.

These objects of the present invention may be achieved by using a control circuit for the semi-conductor switch possessing an integration characteristic to be inoperative to a slow change as of the power source voltage but operative to a quick change as of the pulse voltage.

DESCRIPTION OF THE PREFERRED EMBODIMENTS

Figure 5:
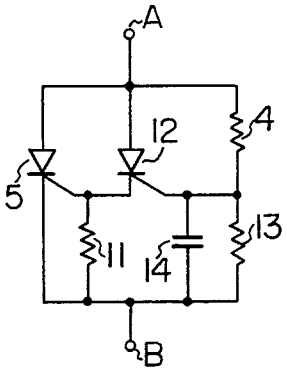
FIG. 5 is a circuit diagram of the major part of an electric discharge lamp lighting device which is an embodiment of the present invention.

Referring now to FIG. 5, there is shown a circuit diagram of a switch element and its associated control circuit of an electric discharge lamp lighting circuit according to the present invention. The remainder of the lighting circuit is the same as that shown in FIG. 3, and thus is not depicted. The control circuit shown in FIG. 5 comprises a thyristor 12, a capacitor 14, and a resistor 13, which constitute an integration circuit. The resistor 4 also contributes to the integration characteristic of the integration circuit. A resistor 11 is connected to the gates of the thyristor 5 and serves to increase the holding current of the thyristor 5. The thyristor 12 is used to feed the trigger current $I_{GT}$ to the gate of the thyristor 5. More particularly, when the resistance of the resistor 11 is 22 ohms, the holding current of the thyristor 5 is 270 mA, and the thyristor 12 operates as an auxiliary thyristor for providing such holding current. The trigger current of the auxiliary thyristor 12 is about 1 mA when the resistance of the resistor 4 is 100 kΩ. It is necessitated that the thyristor 12 is automatically turned off when the thyristor 5 becomes conductive, and thus it is preferable to have an internal resistance presenting a large forward voltage drop when conducting. The capacitor 14 is selected to be 0.68 μF, for example, with which the capacitor has a large integration effect on the pulse voltage and a little effect on the source voltage. Terminals A and B are connected to both the terminals of the capacitor 3 of the electric discharge lamp lighting circuit shown in FIG. 3.

Figure 6:
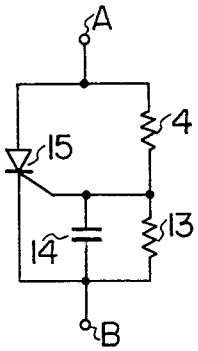
FIGS. 6 through 17 are circuit diagrams of other embodiments of the electric discharge lamp lighting device according to the present invention.

In the thus constructed circuit, the power source 1 feeds its voltage to the gate terminal of the thyristor 12 through the resistor 4, giving a trigger current to the thyristor 12. This trigger current enables the thyristor 12 to be conductive, permitting the flow of the anode current of the thyristor 12. This anode current is fed to the gate of the thyristor 5 as the trigger current $I_{GT}$. The conduction of the thyristor 5 causes the flow of the anode current thereof. At this time, the large forward voltage drop of the thyristor 12 reduces the current flowing therethrough to a value lower than the holding current thereof, which results in the non-conductive condition of the thyristor 12. Under this condition of the auxiliary thyristor 12, on the other hand, the current still continues to flow through the main thyristor 5, heating the filaments of the electrical discharge lamp, as previously stated. When the current flowing in the thyristor 5 reaches the holding current of the thyristor 5, the thyristor 5 becomes in the non-conductive condition, generating a pulse voltage as previously mentioned. This pulse voltage makes the discharge lamp light. At this time, the integration circuit operates to prevent the reconduction of the auxiliary thyristor 12. Otherwise, the pulse voltage would feed the trigger current to the gate of the thyristor 12, making the thyristor reconductive. Thus, the thyristor 12 does not reconduct and thus the thyristor 5 also is not made conductive by the pulse voltage. As a consequence, the operation of lighting the discharge lamp can be performed with high reliability by the pulse voltage generated when the thyristor 5 is turned off. FIG. 6 shows a circuit diagram of another embodiment of the present invention, in which like reference numerals are used to indicate like or equivalent parts in FIG. 5. In the figure, a thyristor 15 is a thyristor with amplifying gate of small size. The use of such a type of thyristor is based on the fact that the operation of the two thyristors of FIG. 5 is similar to that of a thyristor with amplifying gate.

Figure 7:
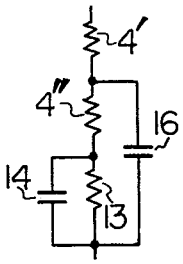

FIG. 7 shows still another embodiment of the present invention, in which two stages of the integration circuit are used. The previous embodiments shown in FIGS. 5 and 6 use one stage of an integration circuit so that a margin in operation is somewhat small and there may be a case where the pulse having a satisfactory amplitude fails to generate when the inductance of the coil 2 or the capacitance of the capacitor 3 in the discharge lamp lighting circuit shown in FIG. 3 are large. In other words, the operable range of the previous embodiments is narrow. The embodiment in FIG. 7 can overcome such defects by such a circuit construction that two resistore 4' and 4'' are employed in place of the resistor 4 of the previous embodiments, and the capacitor 16 is connected to a junction point of these resistors 4' and 4'' to form another integration circuit. By the way, in the circuit of FIG. 7, the thyristor is omitted to be shown.

Figure 8:
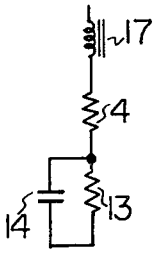

FIG. 8 shows another embodiment of the present invention which is directed to improve such above-mentioned defect that there happens a case where the pulse with a high amplitude is not obtained. The feature of the circuit is the use of the coil 17 connected in series to the integration circuits of the embodiments of FIGS. 5 and 6. The thyristor is omitted to be shown in this example also.

Figure 9:
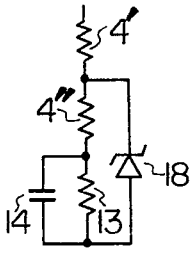

Another embodiment of the present invention shown in FIG. 9 also has the same object as that of the FIG. 8 embodiment, i.e. to obtain a pulse with a high amplitude. In the circuit of this example, a Zener diode 18 is connected to a junction point of resistors 4' and 4'' employed in place of the resistor 4 shown in FIGS. 5 and 6. The Zener diode 18 serves to ensure the pulse generating operation by clipping the amplitude of the pulse voltage at a level higher than the break-down voltage $V_{BO}$ of the thyristor.

Figure 10A:
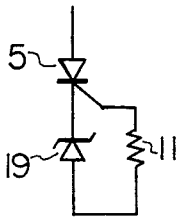
Figure 10B:
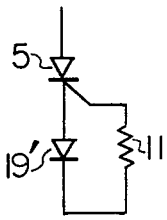

FIGS. 10*a* and 10*b* are circuit diagrams of other embodiments of the present invention which are used to increase the holding current of the thyristors 5 and 15 of the FIGS. 5 and 6. Particularly, in the example of FIG. 5, the resistor 11 connected between the gate and the cathode of the thyristor 5 sometimes fails to obtain a predetermined holding current. The circuits in FIGS. 10*a* and 10*b* are useful in such a case, in which a Zener diode 19 and a diode 19', i.e. constant voltage elements, are connected to the cathode of the thyristor 5 to apply a reverse bias to the thyristor 5. Note that if the thyristor 15 is used in place of the thyristor 5, this measure may be applicable to the example of FIG. 6.

Figure 11:
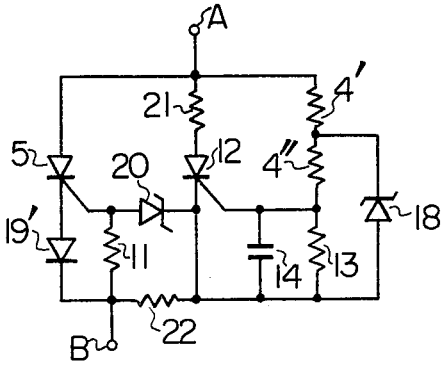

FIG. 11 shows another embodiment of the present invention. In the circuit of this embodiment, the Zener diode 18 as shown in FIG. 9 is applied to the circuit of FIG. 5, and the diode 19' shown in FIG. 10*b* is employed and further voltage generating elements such as the Zener diode 20 and the resistor 21 are connected in series to the thyristor 12. The Zener diode 20 increases the forward voltage drop of the thyristor 12 with the result that when the thyristor 5 becomes conductive, an abrupt cut-off operation of the thyristor 12 is enabled. In this embodiment, a resistor 22 is connected to the thyristor 12, and serves to shunt in part the anode current of the thyristor 12 and thus to reduce the trigger current flowing into the gate of the thyristor 5. As a result, when the thyristor 5 is conductive, the entire circuit current is satisfactorily increased so that the switching operation of the thyristor does not disturb its conductive condition. In this embodiment, the resistor 21 and 22 may of course be omitted and further the Zener diode 20 and the resistor 21 may be exchanged in connection That is, the diode 20 may be connected to the connecting portion of the resistor 21, i.e. to the anode of the thyristor 12. The actual values of the components used in FIG. 11 are as follows: the resistor 4' is 91 kΩ, the resistor 4'' 6.8 kΩ, the resistor 11 33Ω, the resistor 13 680Ω, the capacitor 14 0.68 μF, the constant voltage produced by the Zener diode 18 is 8 V, and the constant voltage of the Zener diode is 6 V.

Figure 12:
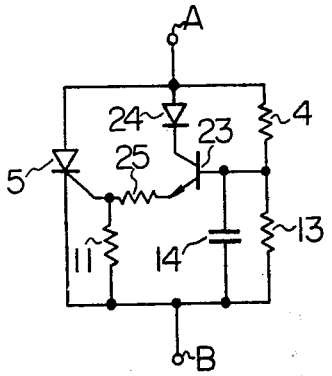

FIG. 12 is a circuit diagram of another embodiment at of the present invention in which a circuit comprising a transistor 23 and a diode 24 is employed instead of the thyristor 12 in the embodiment of FIG. 5. In the figure, the collector of the transistor is connected to the terminal A through the diode 24, while the base of the transistor is connected to the capacitor 14, and the emitter of the transistor is connected to the gate of the thyristor 5 through the resistor 25. Such construction enables an increase of the ratio $I_H/I_{GT}$ of the thyristor 5, as in the case of the thyristor 12 shown in FIG. 4.

Figure 13:
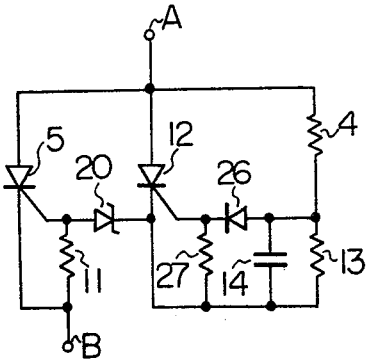

FIG. 13 is another embodiment of the present invention. This circuit of this example is also a modification of the circuit of FIG. 5 in which as described in the case of FIG. 11, the Zener diode 20 is connected to the thyristor 5 and a switching element 26 such as Zener diode or a silicon unidirectional switch is connected with the gate of the thyristor 12. Such switching element 26 enables a stable and reliable feeding of the trigger current to the thyristor 12. Moreover, a resistor 27 may be connected to the switching element 26, as shown in this figure.

Figure 14:
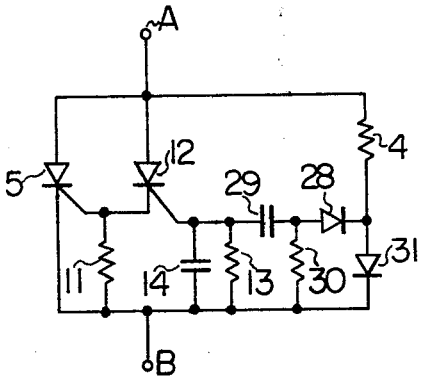
Figure 15:
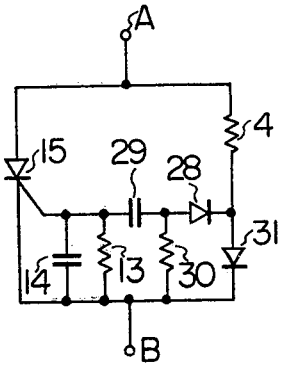

FIGS. 14 and 15 show circuit diagrams of still other embodiments of the present invention, which are also modifications of the circuits shown FIGS. 5 and 6. In these embodiments, a capacitor 29 is connected in parallel with the integration circuit and the charge charged on the capacitor 29 triggers the thyristor 5 or 15 to be conductive. That is, this embodiment is for preventing the re-conduction of the thyristors 5 and 15. The capacitor 29 is charged through the circuit consisting of the resistor 4, the diode 28, the resistor 30, and diode 31 in case the source voltage exhibits a polarity opposite to that of the source voltage itself such that the pulse voltage shown in FIG. 2 is generated. For this, the triggering operation is not affected by the pulse just mentioned.

Figure 16:
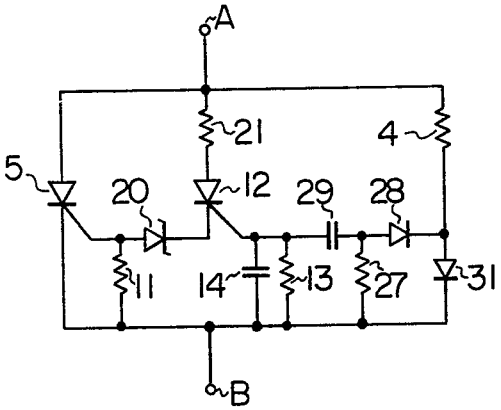

FIG. 16 is also an embodiment of the present invention whose circuit is constructed in a way that the resistor 21 and the constant voltage element 20 shown in FIG. 11 are incorporated into the embodiment shown in FIG. 14, thereby enabling an abrupt cut-off operation of the thyristor 12 while at the same time preventing the re-conduction of the thyristor 5.

While the embodiments described above are ones using the three terminal semiconductor switch, the present invention is not limited to such a switch, but may use any other switch if it can do an operation equivalent to that of the three terminal semiconductor switch.

Figure 17:
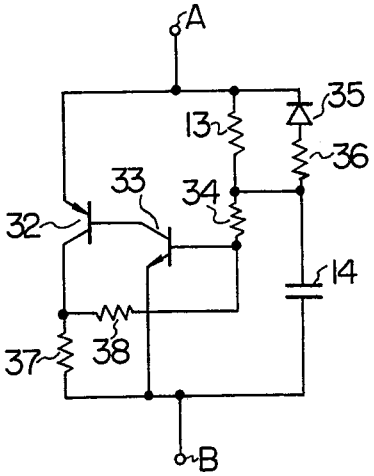

FIG. 17 shows the circuit diagram of another embodiment of the present invention in which an equivalent circuit of a thyristor is used. In the figure, transistors 32 and 33 are combined in a positive feedback connection so as to operate in the same manner as a thyristor. Resistors 37 and 38 are used for the positive feedback, and serve to enable the switching operation of the transistors 32 and 33. A resistor 13 and a capacitor 14 constitute an integration circuit. A resistor 34 is used for avoiding the interference of the integration circuit to the feedback circuit. In this embodiment, the discharging time constant of the capacitor 14 is not shortened so that there happens that the discharging operation during when the transistor holds its conductive condition does not satisfactorily take place. If a discharge circuit consisting of a diode 35 and a resistor 36 which is active when the switching element is conductive is additionally employed, such problem may be eliminated. This discharge circuit may be applicable to the circuits previously described. By the use of the discharge circuit, the impedance of the integration circuit is heightened, permitting the use of the capacitor with a small capacitance.

In this embodiment, the ratio of $I_{GT}$ and $I_H$ is substantially equal to the ratio of resistors 37 and 38, which results in a preamplifier being unnecessary.

What is claimes is:

1. An electric discharge lamp lighting device comprising a discharge lamp having filaments with terminals, said discharge lamp being connected through an inductive ballast to an A.C. power source between first terminals of said filaments thereof, and to a semiconductor switching circuit between second terminals of said filaments of the discharge lamp, said semiconductor switching circuit including:

a first thyristor;

a second thyristor whose anode and cathode are connected to the anode and gate of said first thryistor, respectively; and an integration circuit including at least a capacitor and connected between the anode and the cathode of said first thyristor, said capacitor, being connected between the gate of said second thyristor and the cathode of said first thyristor.

2. A device claimed in claim 1, in which an additional integration circuit comprising a resistor and a capacitor is connected with said integration circuit.

3. A device claimed in claim 1, in which an inductance is connected in series with said integration circuit.

4. A device claimed in claim 1, in which a constant voltage element is connected in parallel with said integration circuit.

5. A device claimed in claim 1, in which a constant voltage element is connected in series with the cathode of said first thyristor.

6. A device claimed in claim 5, in which a resistor is connected between said constant voltage element and the gate of said first thyristor.

7. A device claimed in claim 1, in which a capacitor is connected in parallel with said integration circuit, and further including means for charging the last-mentioned capacitor during the period of time that the polarity of the source voltage is opposite to that of the polarity of the source voltage by which said first thyristor is turned off.

8. A device claimed in claim 7, in which a constant voltage element is provided in a conduction path including said second thyristor between the anode and the gate of said first thyristor.

9. A device claimed in claim 7, in which a resistor is provided in a conduction path including said second thyristor between the anode and the gate of said first thyristor.

10. A device claimed in claim 1, in which a constant voltage element is provided in a conduction path including said second thyristor between the anode and the gate of said first thyristor.

11. A device claimed in claim 10, in which a resistor is connected between the cathodes of said first thyristor and said second thyristor.

12. A device claimed in claim 10, in which a semiconductor switching element is connected in series with the gate of said second thyristor.

13. A device claimed in claim 10, in which a constant voltage element is connected in series with the gate of said second thyristor.

14. A device claimed in claim 1, in which a resistor is provided in a conduction path including said second thyristor between the anode and the gate of said first thyristor.

15. A device claimed in claim 14, in which a resistor is connected between the cathodes of said first thyristor and said second thyristor.

16. A device claimed in claim 14, in which a semiconductor switching element is connected in series with the gate of said second thyristor.

17. A device claimed in claim 14, in which a constant voltage element is connected in series with the gate of said second thyristor.

18. An electric discharge lamp lighting device comprising a discharge lamp having filaments with terminals, said discharge lamp being connected through an inductive ballast to an A.C. power source between first terminals of said filaments thereof, and to a semiconductor switching circuit between second terminals of said filaments of the discharge lamp, said semiconductor switching circuit including:

a thyristor with an amplifying gate whose anode and cathode are connected between the second terminals of said filaments of said discharge lamp; and an integration circuit including at least a capacitor and connected between the anode and the cathode of said thyristor, said capacitor being connected between the gate of said thristor and the cathode of said thristor.

19. A device claimed in claim 18, in which a further integration circuit is connected with said integration circuit, said further integration circuit including at least a capacitor.

20. A device claimed in claim 18, in which an inductance element is connected in series with said integration circuit.

21. A device claimed in claim 18, in which a constant voltage element is connected in parallel with said integration circuit.

22. A device claimed in claim 18, in which a capacitor is connected in parallel with said integration circuit, and further including means for charging the last-mentioned capacitor during the period of time that the polarity of the source voltage is opposite to that of the polarity of the source voltage by which said thyristor with amplifying gate is turned off.

23. A device claimed in claim 18, in which a constant voltage element is connected in series with the cathode of said thyristor with amplifying gate.

24. A device claimed in claim 23, in which a resistor is connected between said constant voltage element and the gate of said thyristor with amplifying gate.

25. An electric discharge lamp lighting device comprising a discharge lamp having filaments with terminals, said discharge lamp being connected through an inductive ballast to an A.C. power source between first terminals of said filaments thereof, and to a semiconductor switching circuit connected between second treminals of said filaments of the discharge lamp, said semiconductor switching circuit including:

a thyristor;

a transistor whose collector and emitter are connected respectively to the anode and the gate of said thyristor;

an integration circuit connected between the collector of said transistor and the cathode of said thyristor and having at least a capacitor, said capacitor being connected between the base of said transistor and the cathode of said thyristor; and a diode connected in series with the collector of said transistor.

26. An electric discharge lamp lighting device comprising a discharge lamp having filaments with terminals, said discharge lamp being connected through an inductive ballast to an A.C. power source between first terminals of said filaments thereof, and to a semiconductor switching circuit between second terminals of said filaments of the discharge lamp, said semiconductor switching circuit including:

a thyristor with amplifying gate; and an integration circuit including at least a parallel connection of a capacitor and resistor connected between the amplifying gate and cathode of said thyristor, and another resistor connected between the amplifying gate and anode of said thyristor.

27. A device claimed in claim 26, in which another capacitor is connected between the cathode of said thyristor and a portion of said another resistor.

28. A device claimed in claim 26, in which a inductance element is connected in series with said integration circuit.

29. A device claimed in claim 26, in which a constant voltage element is connected between the cathode of said thyristor and a portion of said another resistor.

30. A device claimed in claim 26, in which a constant voltage element and an additional resistor are connected in series between the cathode and amplifying gate of said thyristor.

31. A device claimed in claim 26, in which another capacitor is connected in parallel with said integration circuit, and further including means for charging said another capacitor during the period of time that the polarity of the source voltage is opposite to that of the polarity of the source voltage by which said thyristor with amplifying gate is turned off.

* * * * *